US006585581B2

(12) United States Patent
Nottingham et al.

(10) Patent No.: US 6,585,581 B2
(45) Date of Patent: Jul. 1, 2003

(54) COIN SORTING APPARATUS WITH RECIPROCATING COIN PUSHING MEMBER

(75) Inventors: John R. Nottingham, Hunting Valley, OH (US); John W. Spirk, Gates Mills, OH (US); William J. Knox, Jr., Painesville, OH (US); Patrick W. Brown, Mantua, OH (US)

(73) Assignee: Mag-Nif Incorporated, Mentor, OH (US)

( * ) Notice: Subject to any disclaimer, the term of this patent is extended or adjusted under 35 U.S.C. 154(b) by 77 days.

(21) Appl. No.: 09/780,907

(22) Filed: Feb. 9, 2001

(65) Prior Publication Data

US 2002/0019209 A1 Feb. 14, 2002

Related U.S. Application Data

(60) Provisional application No. 60/181,708, filed on Feb. 11, 2000.

(51) Int. Cl.[7] ..... G07D 3/00; G07D 1/00

(52) U.S. Cl. ..... 453/3; 453/37

(58) Field of Search ..... 453/3, 9, 14, 16, 453/18, 29, 31, 32, 33, 37, 39, 41, 59, 61, 63

(56) References Cited

U.S. PATENT DOCUMENTS

| | | | | |
|---|---|---|---|---|
| 3,125,104 A | | 3/1964 | Tryon | 133/5 |
| 3,204,648 A | * | 9/1965 | Rumer, Jr. et al. | 433/2 |
| 3,276,457 A | | 10/1966 | Edds | 133/5 |
| 3,814,115 A | | 6/1974 | Van Acker | 133/4 |
| 4,226,253 A | * | 10/1980 | Kokubo et al. | 453/32 |
| 4,250,905 A | | 2/1981 | Kobayashi et al. | 133/5 R |
| 4,287,900 A | * | 9/1981 | Kokubo et al. | 453/32 |
| 4,374,529 A | | 2/1983 | Kobayashi et al. | 133/4 A |
| 4,607,648 A | | 8/1986 | Hough | 133/3 D |
| 5,827,117 A | * | 10/1998 | Naas | 453/61 |
| 5,902,178 A | | 5/1999 | Perkitny | 453/9 |
| 5,976,006 A | | 11/1999 | Snyder | 453/9 |
| 6,086,473 A | * | 7/2000 | Hayashi et al. | 220/23.4 |
| 6,165,064 A | * | 12/2000 | Aurelius et al. | 453/18 |

OTHER PUBLICATIONS

Mag–Nif Makes it in the U.S.A. !, (Banks, Games, & Puzzles, Just for Fun!, 1998.

Mag–Nif product list—"Mag–Nif makes it in the U.S.A." 1999.

* cited by examiner

*Primary Examiner*—Donald P. Walsh
*Assistant Examiner*—Mark J. Beauchaine
(74) *Attorney, Agent, or Firm*—Fay, Sharpe, Fagan, Minnich & McKee, LLP

(57) ABSTRACT

A coin sorting apparatus includes a coin receiving area, a coin sorting ramp, and a coin stripper. The coin stripper includes an inlet and a backing plate located adjacent said inlet to support a stack of associated unsorted coins received from the inlet with a face of a lowermost coin of the stack abutting the backing plate. The coin stripper further includes a pushing member located adjacent said backing plate and adapted for reciprocal sliding movement relative to said backing plate between an extended position and a retracted position. The pushing member, when moving from the retracted position to the extended position, engages the lowermost coin of the stack and moves the lowermost coin onto the coin sorting ramp.

32 Claims, 8 Drawing Sheets

COIN SORTING APPARATUS WITH RECIPROCATING COIN PUSHING MEMBER

CROSS-REFERENCE TO RELATED APPLICATION

This application claims priority from and hereby expressly incorporates by reference U.S. provisional application No. 60/181,708 filed Feb. 11, 2000.

BACKGROUND OF THE INVENTION

The present invention relates to a coin sorting apparatus. More particularly, the present invention relates to a coin sorting apparatus that is motorized yet compact, and that utilizes a reciprocating coin pushing member to place individual coins from a hopper onto an upper end of a coin sorting ramp/slide. The present invention further relates to a coin sorting apparatus that supports a plurality of flexible coin wrappers on a base so that sorted coins are loaded directly into the appropriate one of the coin wrappers, and so that the base and wrappers are movable as a unit from its operative position, adjacent a main housing portion, to a convenient coin wrapper loading/unloading position wherein the base is moved away from the main housing portion to allow free access to the wrappers.

Coin sorting devices are generally known. A user places one or more coins into a hopper or similar coin receiving location. A motorized coin separating mechanism dispenses coins one at a time from the hopper to a location where they fall under the force of gravity into a coin sorting mechanism. The coin sorting mechanism classifies the coins according to their diameter. Coins of a particular diameter, and consequently of a particular denomination, are directed into the appropriate one of a plurality of sorted coin storage containers and/or wrappers.

One type of motorized coin sorter uses a coin separating plate/disc that is notched at its periphery and that rotates on an adjacent inclined backing plate. Upon rotation of the coin separating disc, individual coins are received in the notches and are moved slidably along the backing plate to an open portion thereof whereupon the coins fall through the open portion of the backing plate onto an upper end of a coin sorting ramp/slide. This type of coin sorting apparatus has been found to be highly effective and has enjoyed widespread commercial success. However, use of the rotating coin separating disc in this manner does impose some design limitations with respect to the size and shape of the housing of the coin sorting apparatus.

Certain prior coin sorting devices operate to deposit sorted coins directly into the appropriate one of a plurality of different flexible coin wrappers, without requiring use of a rigid tubular container to support each wrapper. These prior coin sorting devices have not provided optimal means for convenient loading and unloading of the wrappers. In particular, these prior coin sorting devices that have utilized the flexible wrappers only, without supporting tubes, have typically relied upon a fixed circular collar to support the upper end of each wrapper. These collars have been immovably connected to the coin sorter housing and have required that the coin wrapper be slid axially therethrough. This operation can be inconvenient and somewhat difficult, especially with a filled wrapper. None of these prior devices have included a base for supporting the flexible coin wrappers wherein the base cooperates with a main housing portion to define a collar for each flexible coin wrapper when the base is in an operative position, and wherein the base is movable away from the main housing portion to open each collar and to provide free, unobstructed access to the base for loading/unloading the wrappers.

Accordingly, it has been deemed desirable to develop a new and improved coin sorting apparatus that overcomes the foregoing deficiencies and others while providing better and more advantageous overall results.

SUMMARY OF THE INVENTION

According to the present invention, a new and improved coin sorting apparatus is provided.

In accordance with the present invention, a coin sorting apparatus includes a coin receiving area, a coin sorting ramp, and a coin stripper. The coin stripper includes an inlet and a backing plate located adjacent said inlet to support a stack of associated unsorted coins received from the inlet with a face of a lowermost coin of the stack abutting the backing plate. The coin stripper further includes a pushing member located adjacent said backing plate and adapted for reciprocal sliding movement relative to said backing plate between an extended position and a retracted position. The pushing member, when moving from the retracted position to the extended position, engages the lowermost coin of the stack and moves the lowermost coin onto the coin sorting ramp.

In accordance with another aspect of the present invention, a coin stripping apparatus for moving individual coins from an unsorted coin receiving area to a coin sorting mechanism in a coin sorting apparatus includes an inlet for holding a stacked plurality of coins. A backing plate is located beneath the inlet to support the stacked coins. A planar pushing member is located above the backing plate and is adapted for reciprocating in relation to the backing plate between an extended position and a retracted position. The pushing member engages a lowermost coin of the stacked plurality of coins and moves the lowermost coin to the coin sorting mechanism when moving from the retracted to the extended position.

In accordance with still another aspect of the present invention, a coin sorting apparatus includes a housing, a coin sorting mechanism connected to the housing; and, a door assembly mounted on the housing. The door assembly includes a base with a plurality of supports for retaining a respective plurality of associated coin holders. The door assembly is selectively movable between a closed position, wherein the associated coin holders are operatively positioned to receive sorted coins from said coin sorting mechanism and the door assembly blocks user access to the associated coin holders, and an open position wherein the door assembly including the base is moved relative to the housing for access to the associated coin holders.

In accordance with a further aspect of the present invention, a coin sorting apparatus includes a housing, a coin receiving area located in the housing and adapted for receipt of a plurality of associated coins, a coin sorting ramp located in the housing, and a coin stripper located in the housing for moving individual coins from the coin receiving area onto the coin sorting ramp. The coin stripper includes an inlet in communication with the coin receiving area to receive unsorted coins therefrom. A backing plate is located adjacent the inlet and is adapted to support a stack of associated unsorted coins received from the inlet with a face of a lowermost coin of the stack abutting the backing plate. A pushing member is located adjacent the backing plate and is adapted for reciprocal sliding movement relative to the backing plate between an extended position and a retracted position. The pushing member, when moving from the retracted position to the extended position, engages the lowermost coin of the stack and moves it onto the coin sorting ramp. The apparatus further includes a door assembly having a door member, a base connected to the door member, and a plurality of pedestals projecting upwardly from the base and adapted for insertion in open lower ends of a respective plurality of associated coin holders whereby the holders are operatively supported on the base. The door assembly is movable relative to the housing between a closed, operative position wherein the associated holders supported on the base are positioned to receive sorted coins from the coin sorting ramp and wherein the door prevents user-access to the holders, and an opened position wherein the door assembly and associated holders supported on the base are spaced from the housing and accessible by a user of the coin sorting apparatus.

In accordance with another aspect of the present invention, a coin stripping apparatus for moving individual coins from an unsorted coin receiving area to a coin sorting mechanism in a coin sorting apparatus includes an inlet for holding a stacked plurality of coins, a backing plate located beneath the inlet to support the stacked plurality of coins, and a planar pushing member located above the backing plate. The pushing member is adapted for reciprocal sliding movement in relation to the backing plate between an extended position and a retracted position. When moving from the retracted position to the extended position, the pushing member engages a lowermost coin of the stacked plurality and moves same to the coin sorting mechanism. The pushing member includes a leading edge that engages and pushes the lowermost coin, and the leading edge defines a thickness that is less than a thickness of a thinnest coin in the stacked plurality.

In accordance with a further aspect of the present invention, a coin sorting apparatus comprises a coin receiving area adapted for receipt of a plurality of associated coins, a coin sorting ramp, and a coin stripper for moving individual coins from the coin receiving area onto the ramp. The coin stripper includes an inlet in communication with the coin receiving area to receive unsorted coins therefrom, a backing plate located adjacent the inlet and adapted to support a stack of associated unsorted coins received from the inlet with a face of a lowermost coin of the stack abutting the backing plate. The backing plate is located above at least a portion of the coin sorting ramp and defines a space between itself and the ramp that is smaller than a diameter of a smallest-diameter coin being sorted. A pushing member is located adjacent the backing plate and is adapted for reciprocal sliding movement relative to the backing plate between an extended position and a retracted position. When the pushing member moves from the retracted position to the extended position, it engages a lowermost coin of the stack and moves same onto the coin sorting ramp.

In accordance with another aspect of the present invention, a coin stripping apparatus for moving individual coins from an unsorted coin receiving area to a coin sorting mechanism in a coin sorting apparatus includes an inlet for holding a stacked plurality of coins, a backing plate located beneath the inlet to support the stacked plurality of coins, and a planar pushing member located above the backing plate. The pushing member is adapted for reciprocal sliding movement in relation to the backing plate between an extended position and a retracted position. The pushing member, when moving from the retracted position to the extended position, engages a lowermost coin of the stacked plurality of coins and moves same to the coin sorting mechanism. The pushing member defines a leading edge that engages and pushes the lowermost coin simultaneously in a first direction and in a direction transverse relative the first direction to orient said lowermost coin relative to a subjacent sorting ramp.

In accordance with still another aspect of the present invention, a coin stripping apparatus for moving individual coins from an unsorted coin receiving area to a coin sorting mechanism in a coin sorting apparatus includes an inlet for holding a stacked plurality of coins, a backing plate located beneath the inlet to support the stacked plurality of coins, and a planar pushing member located above the backing plate. The pushing member is adapted for reciprocal sliding movement in relation to the backing plate between an extended position and a retracted position. The pushing member, when moving from the retracted position to the extended position, engages a lowermost coin of the stacked plurality of coins and moves same to the coin sorting mechanism. The pushing member defines a member that projects upwardly therefrom and that shifts unsorted coins in the inlet away from the pushing member when the pushing member reciprocates.

One advantage of the present invention is the provision of a new and improved coin sorting apparatus.

Another advantage of the present invention resides in the provision of a motorized coin sorting apparatus that utilizes a reciprocating coin pushing member in a coin separating mechanism, rather than a rotating disc, to move individual unsorted coins onto an upper portion of a coin sorting ramp/slide without flipping and/or bouncing.

A further advantage of the present invention is found in the provision of a coin sorting apparatus that is more compact owing to its use of a reciprocating coin pushing mechanism positioned above and overlapping at least a portion of the coin sorting ramp/slide.

Still another advantage of the present invention is the provision of a coin sorting apparatus that operates to place sorted coins directly into flexible coin wrappers, and wherein the wrappers are supported on a base that moves to a wrapper loading/unloading position that allows for free, unobstructed placement/removal of wrappers relative to the base.

Yet another advantage of the present invention resides in the provision of a coin sorting apparatus wherein a movable base and a main housing portion cooperate to define a plurality of collars for operably supporting a plurality of sorted coin wrappers at their upper ends when the base in moved to its operative position.

A further advantage of the present invention resides in the provision of a coin sorting apparatus including an off-center infra-red coin sensor associated with each coin chute and adapted for sensing coins moving through the chute.

Still other benefits and advantages of the invention will become apparent to those skilled in the art upon reading and understanding the following detailed description.

BRIEF DESCRIPTION OF THE DRAWINGS

The invention may take form in certain components and structures, a preferred embodiment of which is illustrated in the accompanying drawings wherein.

DETAILED DESCRIPTION OF PREFERRED EMBODIMENT

Figure 1:
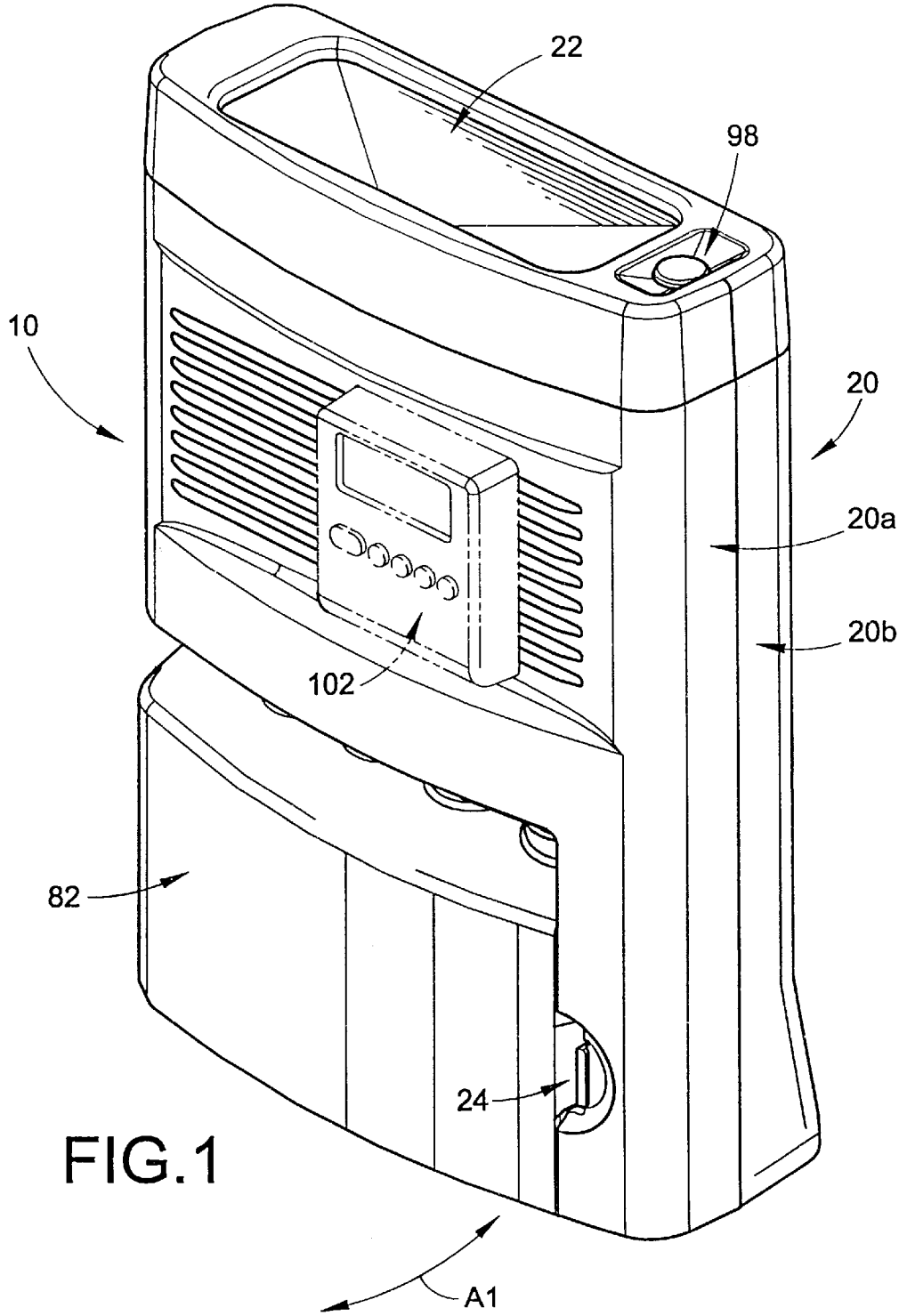
FIG. 1 is a front perspective view of a coin sorting apparatus formed in accordance with the present invention.

Referring now to the drawings, wherein the showings are for purposes of illustrating a preferred embodiment of the invention only and not for purposes of limiting same, FIG. 1 shows a coin sorting apparatus 10 formed in accordance with the present invention. The apparatus includes a main housing 20 manufactured from plastic or a similar conventional material and defined by front and rear housing sections 20*a*, 20*b*. The housing 20 can be defined from a transparent plastic such that the operation of the apparatus can be easily viewed by an operator or a bystander.

Figure 2:
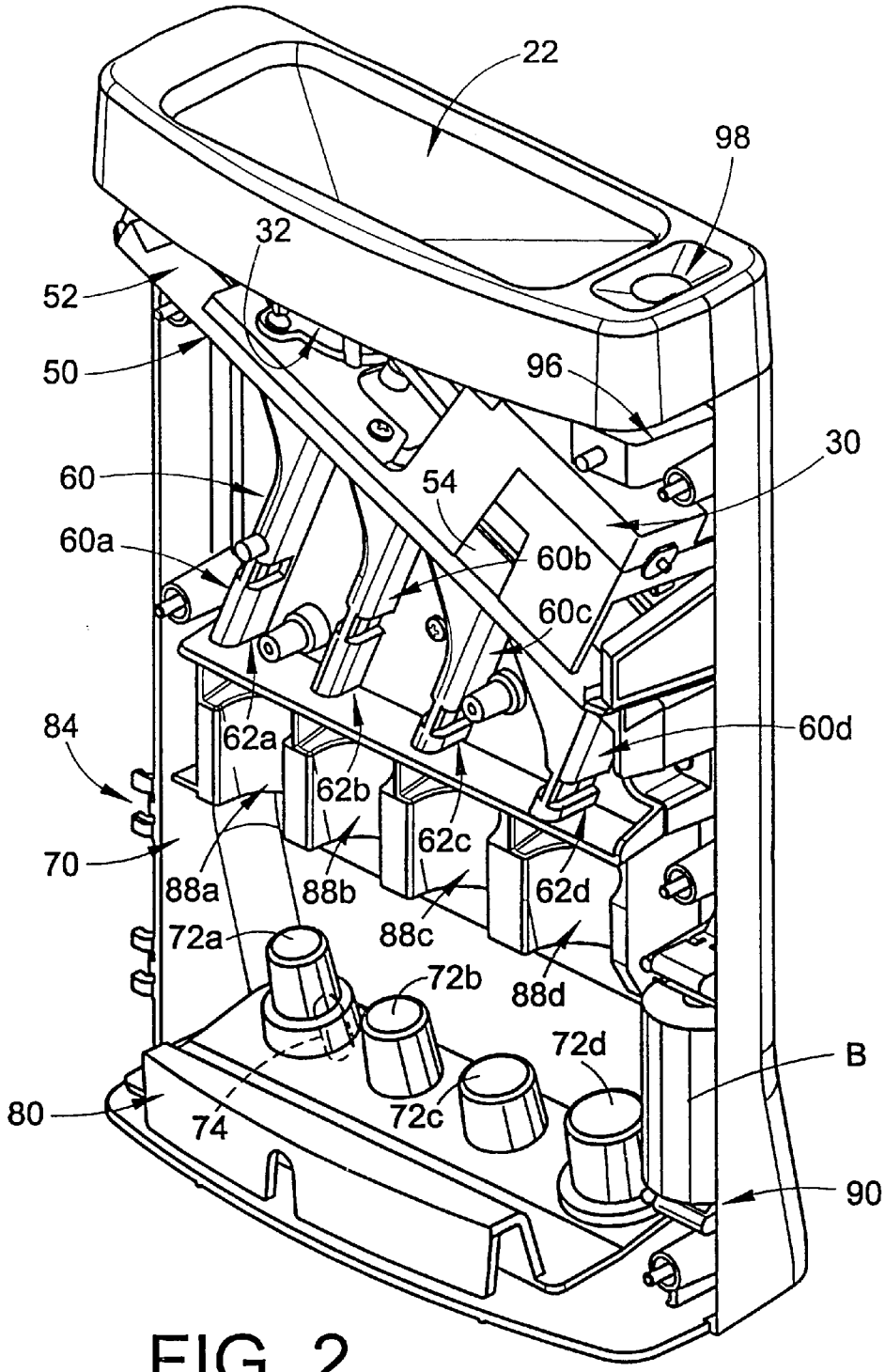
FIG. 2 is an enlarged front perspective view of the coin sorting apparatus of FIG. 1 with a front housing portion removed.

With reference now also to FIG. 2, the coin sorting apparatus 10 includes a coin funnel 22 adapted to receive plural unsorted coins deposited therein by a user. The coin funnel 22 directs unsorted coins deposited therein to an inlet 32 of a coin separating and sorting assembly 30 contained within the housing 20. The coin separating and sorting assembly 30 receives unsorted coins at its inlet 32 and directs each coin to the appropriate one of a plurality of sorted coin chutes 60*a*, 60*b*, 60*c*, 60*d* of a chute assembly 60. In particular, the coin separating and sorting assembly 30 includes means, described below, for moving individual coins from the inlet 32 onto a coin sorting ramp/slide 50 at an upper end 52 of the thereof.

The coin sorting ramp 50 is disposed within the housing 20 so that it slopes downwardly from the upper end 52 to a lower end 54 whereby coins deposited on the upper end 52 of the ramp move downwardly toward the lower end 54 in a controlled fashion. The ramp 50 is made from plastic or another material having a sufficiently low coefficient of friction to allow coins to slide easily thereon. Furthermore, the ramp 50 is placed in the housing 20 so that its slope from the upper end 52 to the lower end 54 is neither too steep nor too gentle so that coins deposited thereon slide in a smooth and uninterrupted fashion, but yet not too fast.

Figure 6:
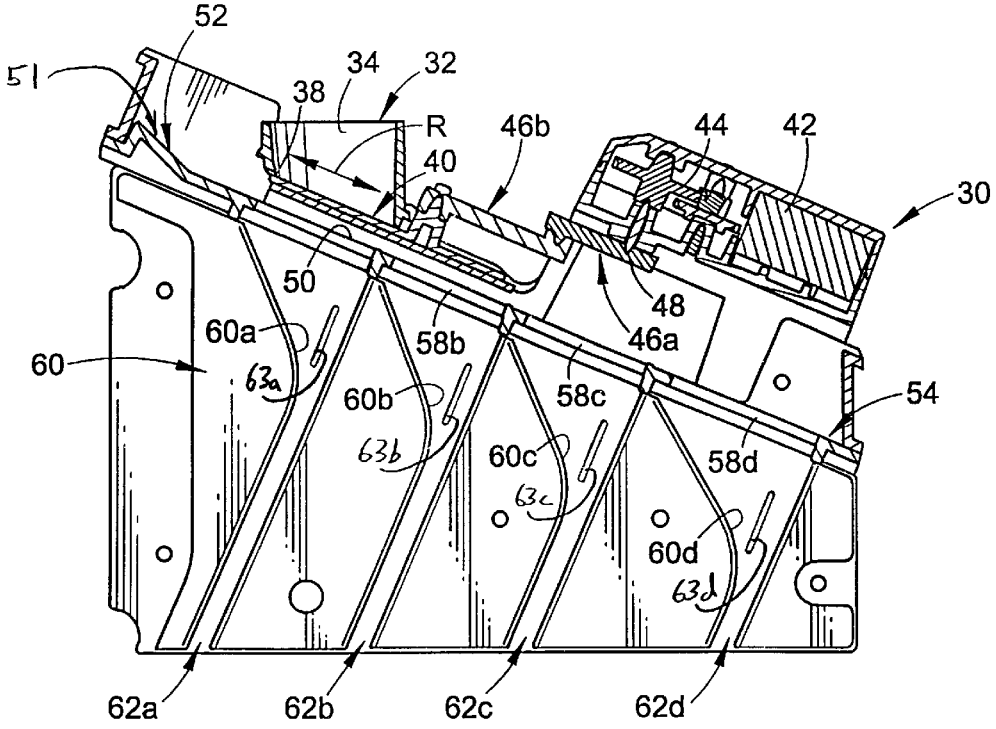
FIG. 6 is a sectional view taken along line 6—6 of FIG. 5.
Figure 7:
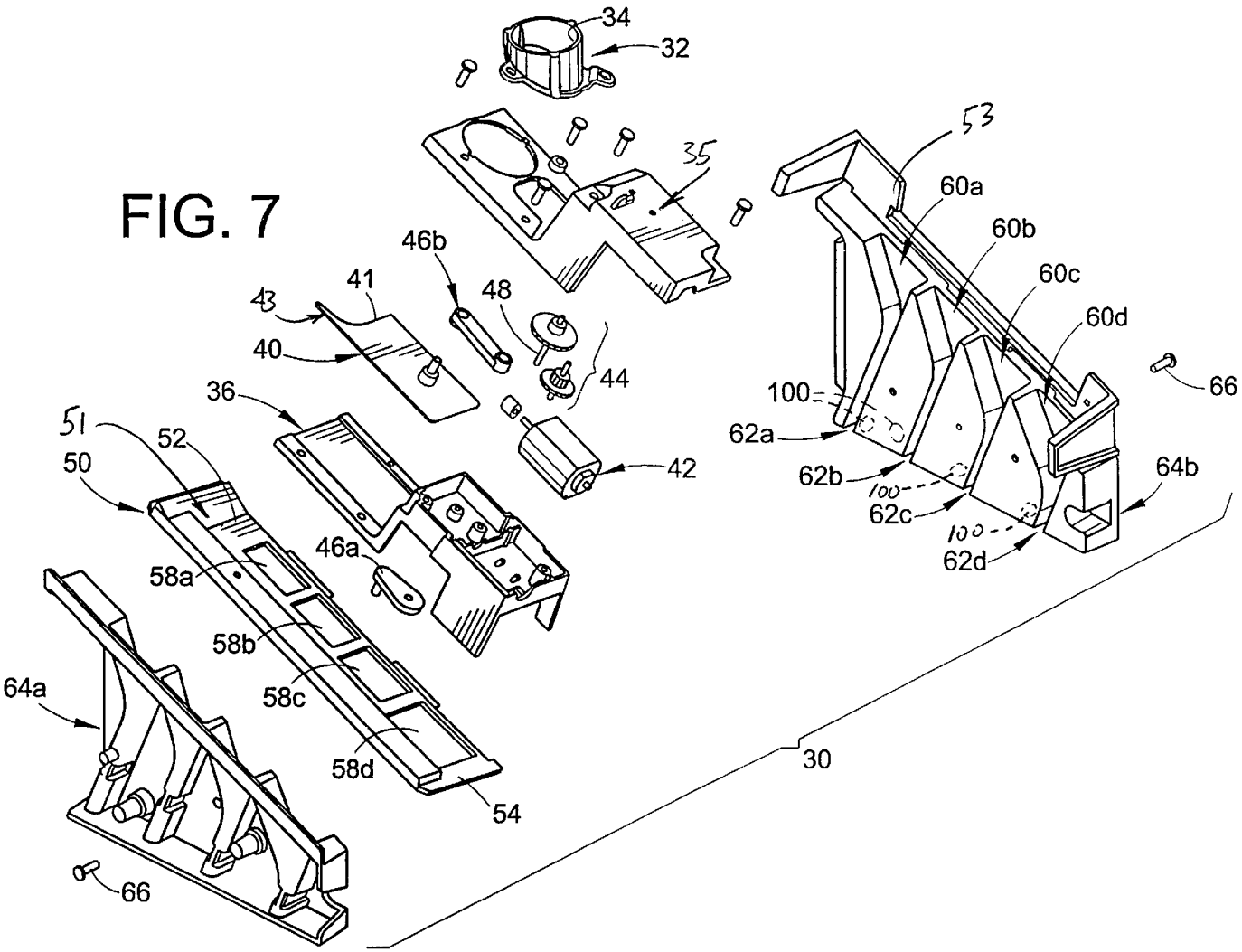
FIG. 7 is an exploded perspective view of the coin separating and sorting assembly of FIG. 5.

With particular reference to FIGS. 6 and 7, the coin ramp 50 includes a plurality of differently sized apertures formed therethrough. The number of apertures formed through the ramp 50 preferably corresponds to the number of differently sized coins in common circulation for the currency of a particular country. Thus, for sorting coins of the United States of America, for example, the ramp 50 preferably defines four differently sized apertures 58*a*–58*d* corresponding to the quarter, nickel, penny and dime, respectively, as shown herein. Of course, more or less apertures 58*a*–58*d* can be used without departing from the overall scope and intent of the present invention. The apertures 58*a*–58*d*, which may be of any suitable geometric shape, are sized such that only coins smaller than a particular diameter will pass therethrough. By arranging the apertures 58*a*–*d* in order of increasing size from the upper portion 52 of the ramp 50 to the lower portion 54 of the ramp 50, the largest coins being sorted will pass over the upstream apertures 58*a*–*c*, as these are too small to allow the passage of the largest coins therethrough. The largest coins will, however, pass through the lowermost (farthest downstream) aperture 58*d*. All of the smaller coins will fall through the appropriate one of the upstream apertures 58*a*–*c*. In particular, upon moving down the ramp 50 from the upper end 52 toward the lower end 54, each unsorted coin will pass through the first aperture 58*a*–*d* encountered that is sufficiently large to allow the passage of that coin. In this manner, the coin sorting apparatus 10 formed in accordance with the present invention sorts the coins of a particular monetary system in terms of their diameter.

With continuing reference to both FIGS. 6 and 7, the coin sorting ramp 50 is positioned in the coin separating and sorting assembly 30 vertically above and overlapping the coin chute assembly 60 that includes and/or defines the coin chutes 60*a*–60*d* so that the apertures 58*a*–58*d* defined in the ramp 50 communicate coins directly to the chutes 60*a*–60*d*, respectively. As shown in FIG. 7, the coin chute assembly 60 is preferably defined from first and second adjacent chute halves 64*a*, 64*b* that are interconnected by any suitable convenient means such as fasteners 66 and/or adhesive. When the chute halves 64*a*, 64*b* are interconnected, the chutes 60*a*–60*d* are defined as closed channels in that the chutes define passages that completely encompass coins moving therethrough. Further, it is preferred that the each chute 60*a*–60*d* converge toward its respective lower end 62*a*–62*b* so that, at its lower end, it defines a space minimally larger than the coin to be handled on the chute to prevent undesired coin wobbling and bouncing.

Figure 4:
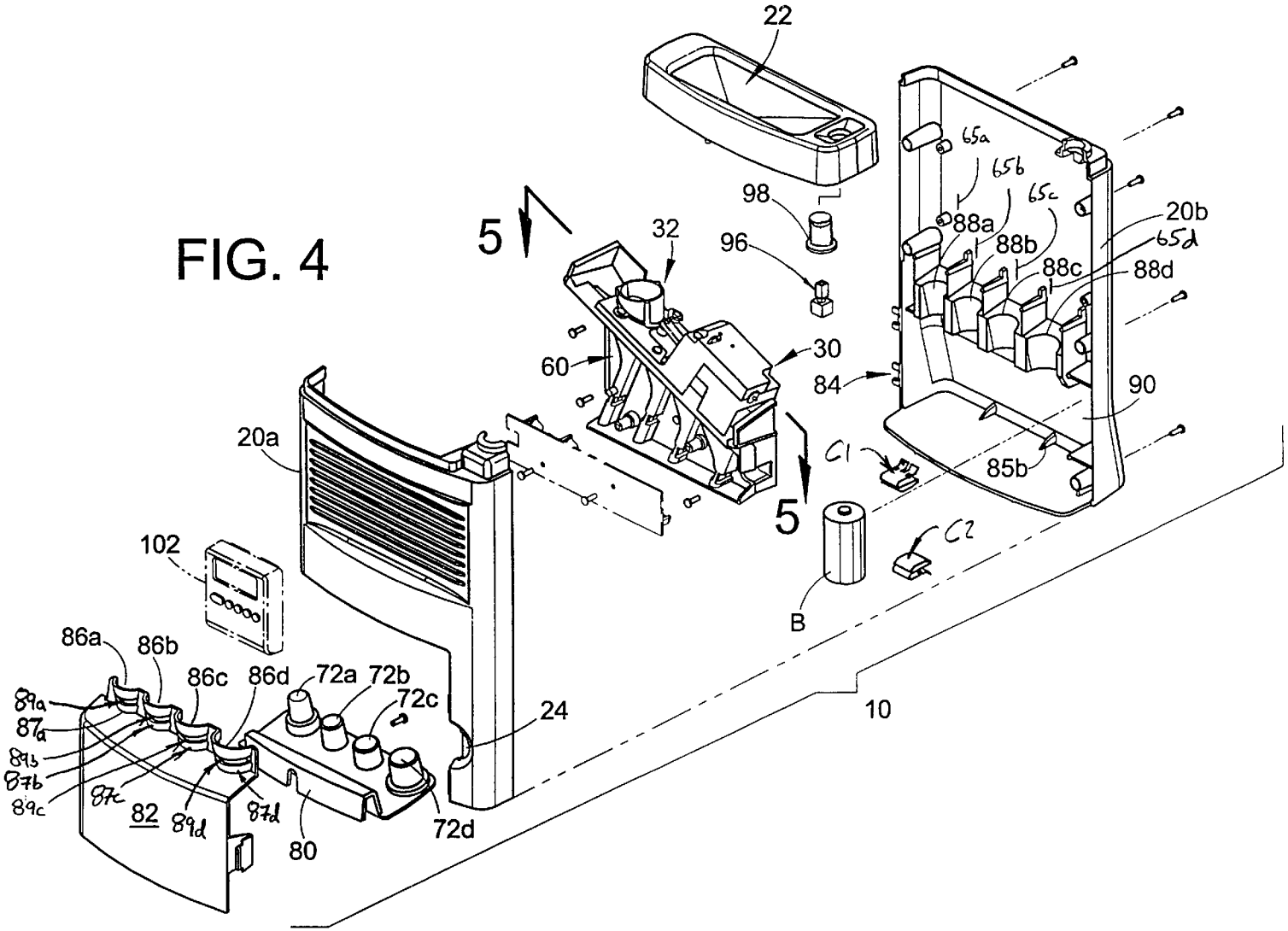
FIG. 4 is a reduced exploded perspective view of the coin sorting apparatus of FIG. 1.

With reference to FIG. 6, the chute halve 64*b* defines a plurality of open slots 63*a*–63*d* in respective communication with the chutes 60*a*–60*d*. Further, as shown in FIG. 4, the housing portion 20*b* defines slots 65*a*–65*d* that are registered respectively with the slots 63*a*–63*d* when the apparatus 10 is assembled. In the event one or more coins becomes lodged in a chute 60*a*–60*d*, a user is able to insert a paper clip wire or other small tool into the relevant aligned pair of slots 65*a*–65*d*, 63*a*–63*d* to dislodge the coin(s) from the chute 60*a*–60*d*.

Figure 3:
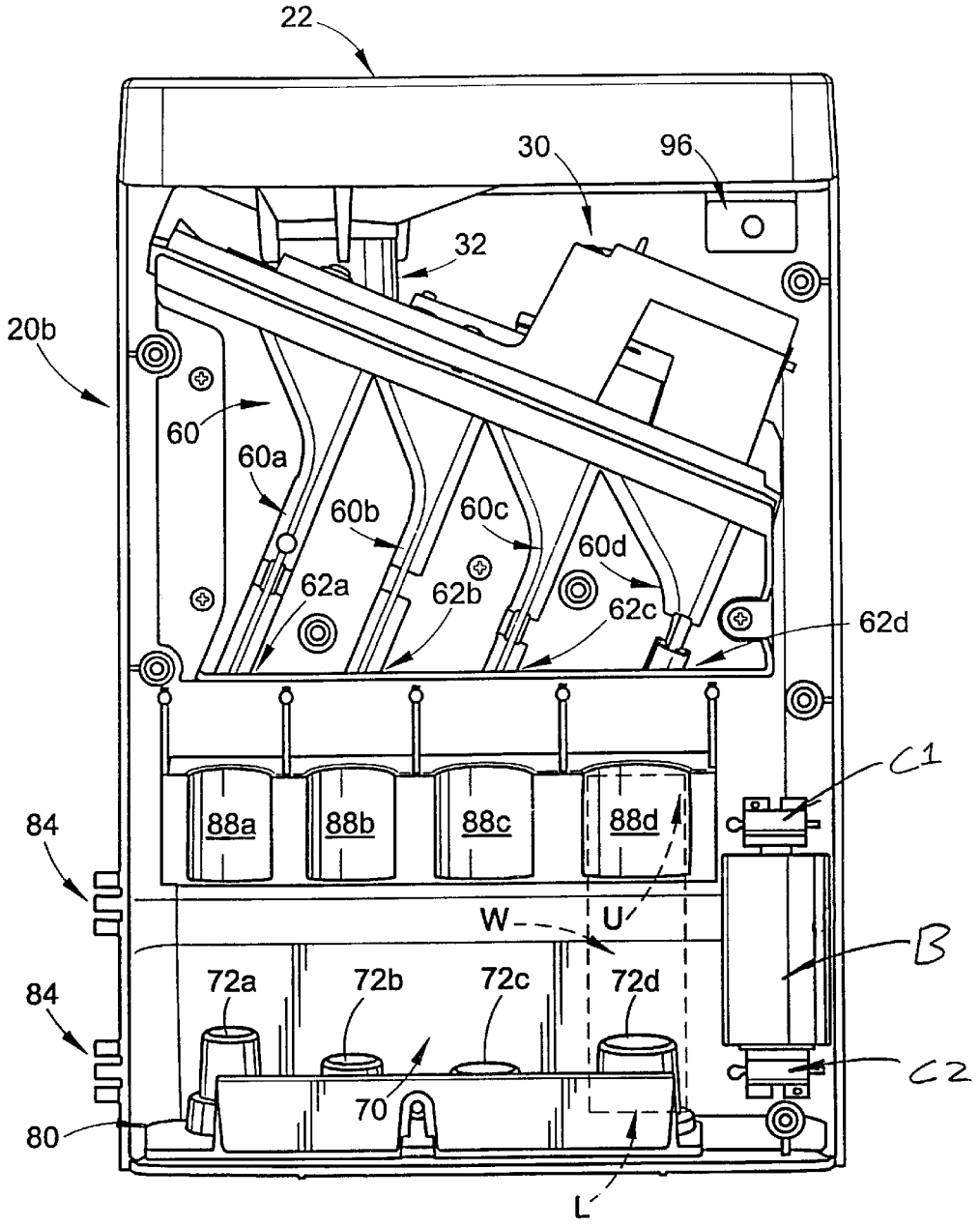
FIG. 3 is an enlarged front elevational view of the coin sorting apparatus of FIG. 1 with a front housing portion removed.

Referring now to FIG. 3, the respective lower ends 62*a*–62*d* of the coin chutes 60*a*–60*d*, in turn, communicate coins to a sorted coin storage area 70 of the coin sorting apparatus 10 wherein the sorted coins are directed into the open upper end U of the appropriate one of a plurality of paper or other flexible coin wrappers W (for clarity and ease of understanding the invention, only one wrapper W is shown in FIG. 3). In particular, the sorted coin storage area 70 of the apparatus 10 comprises a base member 80 including a plurality of supports such as pedestals 72*a*–72*d* (see also FIG. 4) over which the plurality of coin wrappers W are respectively positioned. Each wrapper W has a crimped lower end L encircling a pedestal 72*a*–72*d* and an open upper end U projecting upwardly above the pedestal. The pedestals 72*a*–72*d* are sized to project upwardly into the associated hollow tubular wrapper W a select distance that varies depending upon the pedestal so that the associated wrapper W will be filled to capacity with a select number of coins, i.e., the pedestal height controls he number of coins accommodated in a wrapper W between the pedestal and the open upper end U of the wrapper. In this manner, a user need not manually count the number of sorted coins in each wrapper W. Also, each pedestal and/or the base member 80 adjacent each pedestal optionally includes a finger-access notch 74 (see FIG. 2) defined therein that facilitates removal of an associated coin wrapper from the pedestal.

The base member 80 is connected to or defined as a one-piece construction with a door or cover member 82 (FIGS. 1 and 4) that is, in turn, movably connected to the housing 20 of the coin sorting apparatus 10. In the illustrated embodiment, a fastener 83 (FIG. 4) interconnects the base member 80 and door member 82. Together, the base member 80 and door member 82 define a door assembly 80, 82 for supporting a plurality of associated coin wrappers on the pedestals 72*a*–72*d*. The door assembly 80, 82 is pivotably connected to the rear housing member 20*b* by way of hinges 84 so that the door assembly 80, 82 are adapted for pivoting movement relative to the housing 20 along an arc Al between a closed, operative position (FIG. 1) and an open position pivoted away from the housing 20.

The front housing member 20*a* and/or the cover 82 define(s) a finger-access recess or notch 24 to facilitate manual movement of the door assembly 80, 82 between its closed and opened positions. With reference now again to FIG. 4, the door member 82 includes a resilient tongue 85*a* projecting outwardly therefrom. The tongue 85*a* is adapted to engage a mating potion 85*b* of the housing 20 to releasably secure the door assembly 80, 82 in the closed position. To open the door assembly, a user exerts manually force on the tongue 85*a* to disengage it from the mating housing portion 85*b*. The tongue 85*a* or a like lock member can be mounted to either the door member 82 or housing 20.

An upper portion of the cover member 82, spaced from the base member 80, includes or defines a plurality of recesses 86*a*–86*d* (FIG. 4) that are aligned with the pedestals 72*a*–72*d* so that when associated coin wrappers W are placed over the pedestals 72*a*–72*d*, the upper end U the wrappers W are respectively received in the recesses 86*a*–86*d*. The rear housing member 20*b* of the apparatus 10 includes or defines a plurality of recesses 88*a*–88*d* that, when the door assembly 80, 82 is closed, are placed in opposed facing relation to the recesses 86*a*–86*d* and similarly receive the upper end of the wrappers W supported on the pedestals 72*a*–72*d*, respectively. Those of ordinary skill in the art will recognize that when the door assembly 80, 82 is placed in its closed position, respective facing pairs of recesses 86*a*–86*d*, 88*a*-d together define a collar for supporting and holding the upper ends of the wrappers W supported on the pedestals 72*a*–72*d*. Further, when the door assembly 80, 82 is in the closed position, the open upper ends U of the plurality of coin wrappers W are positioned respectively directly beneath the lower ends 62*a*–62*d* of the coin chutes 60*a*–60*d* to receive coins therefrom. Of course, those of ordinary skill in the art will recognize that rigid coin containers can be used as an alternative to the illustrated flexible wrappers W, or that the wrappers W can be placed within rigid containers if desired. It is not intended that the invention be limited to the particular embodiment illustrated herein.

As shown in FIGS. 2 and 4, the base 80 is sloped downwardly moving toward the door 82. Thus, wrappers W supported on the pedestals 72*a*–72*d* are not vertical but are tilted so that their upper ends U are tilted toward the door 82. As described below, this facilitates sliding movement of overflow coins over a filled wrapper and out of the housing 20.

The recesses 86*a*–86*d* of the cover member 82 are each partially defined by a vertical lip or wall 87*a*–87*d* each including an overflow slot 89*a*–89*d* defined therein. These walls 87*a*–87*d* provide additional support for the wrappers W and act as a stop member to direct coins from the chutes 60*a*–60*d* into the appropriate wrapper W. Also, when the height of stacked coins in a wrapper W supported in one of the recesses 86*a*–86*d* reaches the overflow slot 89*a*–89*d* defined in the wall, additional coins destined for that wrapper W will not be stopped by the wall 87*a*–87*d* and, instead, will exit the housing 20 of the coin sorting apparatus 10 through the respective slot 89*a*–89*d*. The position of the slots 89*a*–89*d* in walls 87*a*–87*d* (i.e., the height of the slots above the base member 80) and/or the height of each pedestal 72*a*–72*d* above the base member 80 can be varied to control the maximum number of sorted coins to be received in each wrapper W. Excess coins exit the housing 20 through the relevant overflow slot 89*a*–89*d*.

Figure 5:
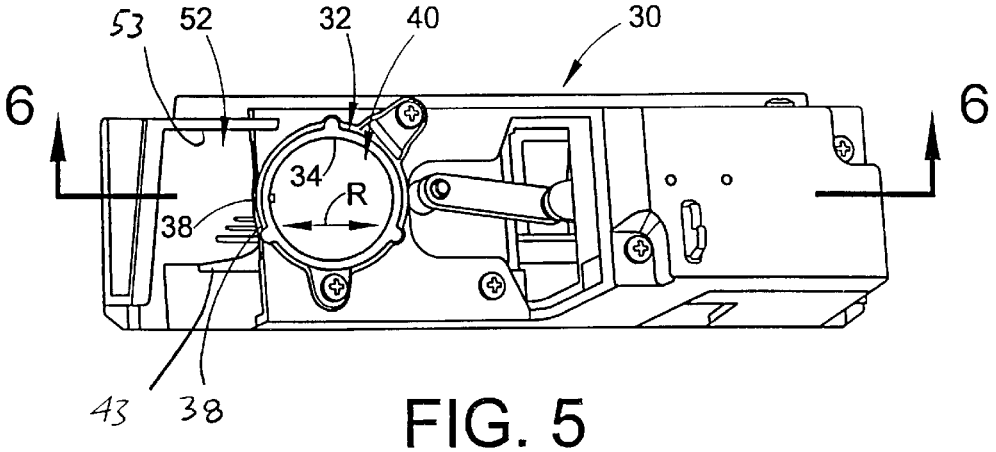
FIG. 5 is a top plan view, taken along line 5—5 of FIG. 4, showing the coin separating and sorting assembly of the coin sorting apparatus illustrated in FIGS. 1–4.

With particular reference now to FIGS. 5–7, a preferred coin separating and sorting assembly 30 is described in further detail. The unsorted coin inlet 32 that receives coins from the funnel 22 defines a tubular bore 34 that receives and retains unsorted coins in a stacked configuration. The inlet 32 is connected to a housing 35 and positioned above a backing plate 36, and a coin outlet slot 38 is defined between the backing plate 36 and the inlet 32. This slot 38 is defined so that only a single coin is able to pass therethrough at any one time on its obverse or reverse face, and so that all of the coins being sorted are able to pass therethrough, i.e., the slot is dimensioned so that the thickest coin, but not a stack of two of the thinnest coin, can pass therethrough. Accordingly, unsorted coins stacked in the bore 34 of the inlet 32 are supported by the backing plate 36 parallel thereto. It is preferred that the backing plate 36 at least partially overlie the coin sorting ramp/slide 50, although other configurations are contemplated.

Coins are moved individually through the slot 38 by a coin stripping or pushing member 40 that reciprocates in a plane parallel to the backing plate 36 as indicated by the arrow R. The pushing member 40 lies closely adjacent the backing plate 36 so that no coins can move between the pushing member 40 and the backing plate 36. Further, the pushing member 40 has a thickness that is less than the thickness of the thinnest coin to be sorted so that it can move only a single coin at any one time, i.e., the coin pushing member cannot simultaneously act on two stacked coins.

The coin pushing member 40 reciprocates between an extended position and a retracted position, and is illustrated in FIGS. 5 and 6 in its extended position. When it is fully retracted from this extended position, a coin in the bore 34 of the inlet 32 will drop downwardly and lie against the backing plate 36 on one of its faces. When the pushing member 40 is again moved to its extended position, the coin resting on the backing plate 36 will be moved by a leading edge 41 (FIG. 7) of the pushing member 40 through the slot 38 so that it falls onto the upper portion 52 of the coin sorting ramp/slide 50. Owing to the dimensions of the slot 38 and the pushing member 40 as described above, movement of the pushing member 40 from its retracted position to its extended position results in the passage of only a single coin through the slot 38. Any other coin(s) located in the inlet bore 34 will rest on the pushing member 40, itself, as it slides beneath these coins when it is moved to its extended position.

To control the lateral position of a coin being pushed by the pushing member 40, it is preferred to conform the leading edge 41 of the pushing member to have a projecting finger 43 that decreases in width moving away from the leading edge 41. This finger 43 will move a coin laterally into abutment with a sidewall 53 that projects upwardly adjacent the slot 38. In this manner, proper orientation of the coin being pushed by the member 40 is ensured as the coin moves through the slot 38 and onto the ramp 50. Of course, the leading edge 41 can be recessed, evenly sloped, or otherwise conformed to control the position of a coin being pushed by the member 40.

Figure 9:
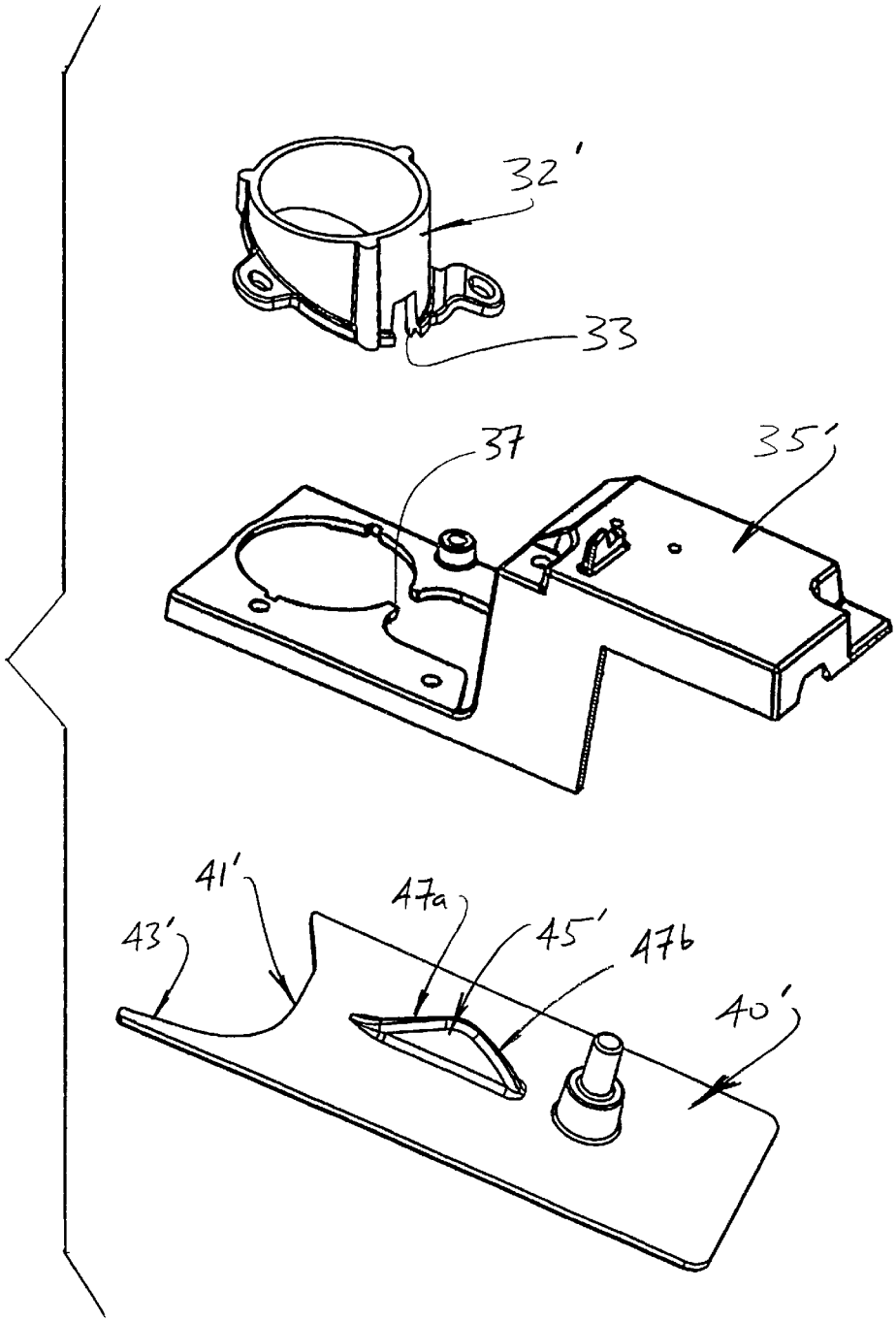

FIG. 9 illustrates an alternative embodiment for the coin stripping assembly wherein like components are identified with like reference numerals including a primed suffix. In this alternative embodiment, the coin pushing member 40' includes a fin 45 that projects outwardly therefrom away from the backing plate 36. The fin 45 defines sloped leading and trailing edges 47*a*, 47*b*. The coin inlet 32' and housing 35' define respective slots or openings 33, 37 that are aligned with the fin 45. As the pushing member 40' reciprocates, the fin 45 moves into and out of the inlet 32' through the slot 33. As the fin 45 moves into and out of the inlet 32', coins stacked in the inlet are shifted or jogged away from the pushing member 40', itself, with sufficient force so that all coins in the inlet 32' are shifted into a neat stack, with faces of adjacent coins abutting. This action prevents coins from becoming jammed in the inlet 32' and ensures that coins presented to the pushing member 40' are properly oriented.

To further minimize undesired coin movement such as tumbling, flipping and/or bouncing, the coin sorting ramp 50 is positioned parallel to and directly vertically beneath the backing plate 36. It is most preferred that the ramp 50 be spaced beneath the backing plate 36 between only one and two times the thickness of the thickest coin being sorted, although any space less than the diameter of the smallest-diameter coin being sorted will be sufficiently small. Furthermore, as may be seen in FIG. 6, the upper portion 52 of the ramp 50 preferably includes a wedge portion 51 inclined in the same direction as the ramp 50 but at a steeper angle. This wedge portion 51 ensures that coins received from the slot 38 move with sufficient speed onto the remaining portion of the ramp 50 so that jams are avoided.

The coin sorting and separating assembly 30 includes means for reciprocating the coin pushing member 40 as described. Preferably, the coin sorting and separating assembly includes an electric motor 42 operably coupled to a gear train 44 or other torque transferring mechanism. The gear train 44 is operably coupled to a first connecting link 46*a* that is, in turn, operably coupled to a second connecting link 46*b*. The second connecting link 46*b* is operably coupled to the coin pushing member 40. Operation of the electric motor 42 causes rotation of an output shaft 48 of the gear train 44. The first connecting link 46*a* is connected to the output shaft 48 to rotate therewith, and rotation of the first connecting link 46*a* causes reciprocation of the second connecting link 46*b* and the coin pushing member 40.

The housing 20 of the coin sorting apparatus 10 includes or defines a battery storage compartment 90 adapted to receive and retain a battery B (FIG. 4) between first and second electrical contacts C1, C2. The coin sorting apparatus 10 includes conventional wiring for electrically connecting the battery B located in the compartment 90 to the electric motor 42 by way of an electrical switch 96. As illustrated herein, the switch 96 is push-button activated and, thus, includes a push-button 98 preferably located adjacent the funnel 22 and spring-biased into the open position. A user of the apparatus 10 is able to depress and hold the push-button 98 after depositing unsorted coins in the funnel 22. Of course, other switches, such as toggle switches or the like are contemplated, and it is not intended that the invention be limited to any particular electrical switch.

If desired, the coin sorting apparatus can include means for automatically detecting the presence of coins in the funnel 22 and/or inlet 32 and for energizing the motor 42 when coins are detected. Those of ordinary skill in the art will also recognize that the apparatus 10 can additionally or alternatively include means for manually reciprocating the coin pushing member 40. For example, a hand crank (not shown) can be operably coupled to the gear train 44 for delivering input torque thereto.

In operation, a user deposits unsorted coins into the funnel 22 and operates the push-button 98 so that the motor 42 is energized. The motor 42 drives the coin pushing member 40 in a reciprocal manner as described so that the unsorted coins are moved individually onto the upper portion 52 of the coin sorting ramp/slide 50. The coins placed on the upper portion of the ramp/slide 50 move downwardly toward the lower end 54 thereof and pass through the appropriate one of the apertures 58*a*–58*d* and into the corresponding appropriate chute 60*a*–60*d*. Coins from the chutes 60*a*–60*d* are deposited into the wrappers W respectively supported on the pedestals 72*a*–72*d* of the door assembly 80, 82 when the door assembly is in its closed position. When one or more wrappers W fills with coins, or when otherwise desired, the door assembly 80, 82 is pivoted to its open position on the arc A1 so that a user is provided with convenient access to the base assembly 80, 82 for loading/unloading wrappers W. When the door assembly 80, 82 is closed, coins destined for a filled wrapper W slide over the top of the filled wrapper and exit the housing 20 through the relevant overflow slot 89*a*–89*d*.

Figure 8:
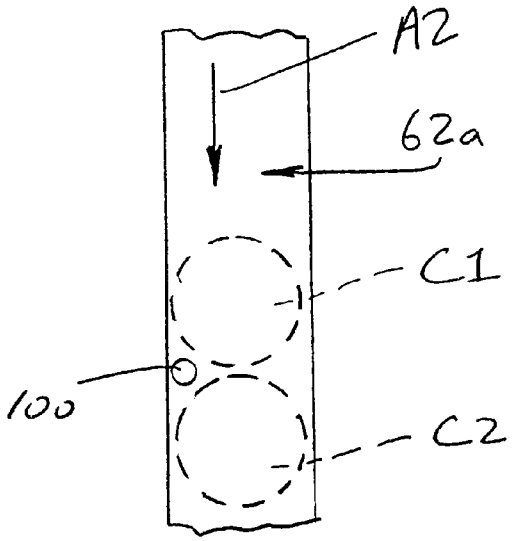
FIG. 8 is a diagrammatic illustration of a preferred arrangement for the infra-red coin sensor positioned adjacent each coin chute; and, FIG. 9 is an exploded perspective of another coin separating assembly according to the present invention.

The apparatus 10 optionally includes contact or non-contact (e.g., infrared) sensors 100 (FIG. 7) in or adjacent each coin chute 60*a*–60*d* or otherwise suitably located to sense the passage of individual coins through each chute 60*a*–60*d* or otherwise into each wrapper W. These sensors 100 are operably connected to a coin counting display and control system 102 (FIG. 1) that, based upon input from the sensors 100, counts the number of each coin denomination sorted by the apparatus 10 and displays a count value and/or a monetary value for each type of sorted coin. An example of a preferred location for the sensors 100 in each coin chute 60*a*–60*d* is partially shown in FIG. 8 using the chute 60*a* as an example. There, it can be seen that the sensor 100 is not located centrally in the chute. This off-center or off-axis location ensures that, in the event two abutting coins C1, C2 move over the sensor 100, both will be counted due to the fact that the point of abutment between the two coins does not pass over the sensor 100.

The invention has been described with reference to a preferred embodiment. Obviously, modifications and alterations will occur to others upon reading and understanding the preceding specification. It is intended that the invention be construed as including all such modifications and alterations insofar as they fall within the scope of the appended claims as construed literally or in accordance with the doctrine of equivalents.

Having thus described the preferred embodiment, what is claimed is:

1. A coin sorting apparatus comprising:

a coin receiving area adapted for receipt of a plurality of associated coins;

a coin sorting ramp;

a coin stripper for moving individual coins from said coin receiving area onto said coin sorting ramp, said coin stripper comprising:

an inlet in communication with said coin receiving area to receive unsorted coins from said coin receiving area;

a backing plate located adjacent said inlet and adapted to support a stack of associated unsorted coins received from said inlet with a face of a lowermost coin of said stack abutting said backing plate; and, a pushing member located adjacent said backing plate and adapted for reciprocal sliding movement relative to said backing plate between an extended position and a retracted position, said pushing member, when moving from said retracted position to said extended position, engaging said lowermost coin of said stack and moving said lowermost coin onto said coin sorting ramp.

2. The coin sorting apparatus as set forth in claim 1, wherein said coin sorting ramp comprises a planar member inclined downwardly from an upper end to a lower end and including a plurality of differently sized apertures defined therein and arranged in order of increasing size from said upper end to said lower end, and wherein said backing plate is a planar member located vertically above said coin sorting ramp.

3. The coin sorting apparatus as set forth in claim 1, further comprising:

an electric motor operatively coupled to said pushing member for reciprocating said pushing member between said extended and retracted positions.

4. The coin sorting apparatus as set forth in claim 1, further comprising:

a plurality of coin chutes connected to said housing, each of said coin chutes located to receive coins of a different select denomination from said coin sorting ramp.

5. The coin sorting apparatus as set forth in claim 4, further comprising a plurality of coin sensors connected respectively adjacent said plurality of coin chutes to sense.

6. The coin sorting apparatus as set forth in claim 1, wherein said coin receiving area, said coin sorting ramp and said coin stripper are held within a housing, said coin sorting apparatus further comprising:

a door assembly comprising: (i) a door member; (ii) a base connected to said door member; and, (iii) a plurality of pedestals projecting upwardly from said base and adapted for insertion in open lower ends of a respective plurality of associated coin holders whereby said holders are operatively supported on said base, said door assembly movable relative to said housing between a closed, operative position wherein said associated holders supported on said base are positioned to receive sorted coins from said coin sorting ramp and wherein said door prevents user-access to said holders, and an opened position wherein said door assembly and associated holders supported on said base are spaced from said housing and accessible by a user of said coin sorting apparatus.

7. The coin sorting apparatus as set forth in claim 6, wherein said door assembly is pivotably connected to said housing and movable on an arc between said closed and opened positions.

8. The coin sorting apparatus as set forth in claim 7, further comprising:

a lock mounted on one of the door and the housing for selectively securing the door to said housing.

9. The coin sorting apparatus as set forth in claim 6, wherein said door member defines a plurality of first open recesses spaced vertically from said plurality of recesses, respectively, said first open recesses adapted for receiving and supporting an upper portion of said respective plurality of associated coin holders supported on said base.

10. The coin sorting apparatus as set forth in claim 9, wherein said housing defines a plurality of second open recesses located in respective opposed facing relation with said plurality of first open recesses of said door assembly when said door assembly is located in said closed position, said first recesses and said opposed second recesses together defining a plurality of collars for respectively retaining and supporting open upper ends of said plurality of coin holders supported on said door assembly.

11. The coin sorting apparatus as set forth in claim 9, wherein said plurality of first open recesses defined in said door member are at least partially defined by a respective plurality of walls that project upwardly from said door member, each of said walls conformed and dimensioned so that coins destined for a filled one of said plurality of associated coin holders move past said wall and exit said housing.

12. The coin sorting apparatus as set forth in claim 11, wherein each of said walls defines a coin overflow slot therethrough whereby coins destined for a filled one of said plurality of associated coin holders pass through said slot of said wall supporting said filled one of said associated wrappers.

13. A coin stripping apparatus for moving individual coins from an unsorted coin receiving area to a coin sorting mechanism in a coin sorting apparatus, said coin stripping apparatus comprising:

an inlet for holding a stacked plurality of coins;

a backing plate located beneath said inlet to support said stacked plurality of coins;

a planar pushing member located above said backing plate, said pushing member adapted for reciprocal sliding movement in relation to said backing plate between an extended position and a retracted position, said pushing member, when moving from said retracted position to said extended position, engaging a lowermost coin of said stacked plurality of coins and moving said lowermost coin to the coin sorting mechanism.

14. The coin stripping apparatus as set forth in claim 13, wherein said pushing member defines a leading edge that engages and pushes said lowermost coin simultaneously in a first direction and in a direction transverse relative said first direction to orient said lowermost coin.

15. The coin stripping apparatus as set forth in claim 13, wherein said pushing member defines a leading edge that engages and pushes said lowermost coin, said leading edge defining a thickness that is less than a thickness of a thinnest coin in said stacked plurality of coins.

16. The coin stripping apparatus as set forth in claim 15, further comprising a restricted opening defined between said inlet and said coin sorting mechanism, said restricted opening dimensioned to allow passage of a largest diameter and thickest coin in said stacked plurality of coins while preventing passage therethrough of a stack of two of said thinnest coins.

17. The coin stripping apparatus as set forth in claim 16, further comprising:

a motor operatively coupled to said pushing member to move said pushing member reciprocally between said extended and retracted positions.

18. A coin sorting apparatus comprising:

a housing;

a coin sorting mechanism connected to said housing; and, a door assembly mounted on said housing and comprising a base including a plurality of supports for retaining a respective plurality of associated coin holders wherein said door assembly is selectively movable between a closed position, wherein said associated coin holders are operatively positioned to receive sorted coins from said coin sorting mechanism and said door assembly blocks user access to said associated coin holders, and an open position wherein said door assembly including said base is moved relative to said housing for access to said associated coin holders, each of said plurality of supports of said base comprising a pedestal adapted for insertion into a lower end of an associated coin holder.

19. The coin sorting apparatus as set forth in claim 18, wherein said door assembly is connected to said housing by a hinge assembly whereby said door assembly pivots on an arc relative to said housing between said closed and open positions.

20. The coin sorting apparatus as set forth in claim 18, wherein each of said pedestals defines a different height above said base.

21. A coin sorting apparatus comprising:

a housing;

a coin sorting mechanism connected to said housing; and, a door assembly mounted on said housing and comprising a base including a plurality of supports for retaining a respective plurality of associated coin holders wherein said door assembly is selectively movable between a closed position, wherein said associated coin holders are operatively positioned to receive sorted coins from said coin sorting mechanism and said door assembly blocks user access to said associated coin holders, and an open position wherein said door assembly including said base is moved relative to said housing for access to said associated coin holders, said door assembly further comprising a door member that defines a plurality of open recesses aligned with and spaced from said plurality of supports, respectively, whereby an open upper end of each of said plurality of associated coin holders is received in one of said open recesses when said associated coin holders are supported on said plurality of supports.

22. The coin sorting apparatus as set forth in claim 21, wherein each open recess defined in said door member includes a coin overflow slot defined therethrough at a select height above said base so that coins traveling from said coin sorting mechanism to a filled one of said associated coin holders exit said coin sorting apparatus through said coin overflow slot of the recesses in which said filled associated coin holder is positioned.

23. A coin sorting apparatus comprising:

a housing;

a coin receiving area located in said housing and adapted for receipt of a plurality of associated coins;

a coin sorting ramp located in said housing;

a coin stripper located in said housing for moving individual coins from said coin receiving area onto said coin sorting ramp, said coin stripper comprising:

an inlet in communication with said coin receiving area to receive unsorted coins from said coin receiving area;

a backing plate located adjacent said inlet and adapted to support a stack of associated unsorted coins received from said inlet with a face of a lowermost coin of said stack abutting said backing plate; and, a pushing member located adjacent said backing plate and adapted for reciprocal sliding movement relative to said backing plate between an extended position and a retracted position, said pushing member, when moving from said retracted position to said extended position, engaging said lowermost coin of said stack and moving said lowermost coin onto said coin sorting ramp; and, a door assembly comprising: (i) a door member; (ii) a base connected to said door member; and, (iii) a plurality of pedestals projecting upwardly from said base and adapted for insertion in open lower ends of a respective plurality of associated coin holders whereby said holders are operatively supported on said base, said door assembly movable relative to said housing between a closed, operative position wherein said associated holders supported on said base are positioned to receive sorted coins from said coin sorting ramp and wherein said door prevents user-access to said holders, and an opened position wherein said door assembly and associated holders supported on said base are spaced from said housing and accessible by a user of said coin sorting apparatus.

24. A coin stripping apparatus for moving individual coins from an unsorted coin receiving area to a coin sorting mechanism in a coin sorting apparatus, said coin stripping apparatus comprising:

an inlet for holding a stacked plurality of coins;

a backing plate located beneath said inlet to support said stacked plurality of coins;

a planar pushing member located above said backing plate, said pushing member adapted for reciprocal sliding movement in relation to said backing plate between an extended position and a retracted position, said pushing member, when moving from said retracted position to said extended position, engaging a lowermost coin of said stacked plurality of coins and moving said lowermost coin to the coin sorting mechanism, said pushing member comprising a leading edge that engages and pushes said lowermost coin, said leading edge defining a thickness that is less than a thickness of a thinnest coin in said stacked plurality of coins.

25. A coin sorting apparatus comprising:

a coin receiving area adapted for receipt of a plurality of associated coins;

a coin sorting ramp;

a coin stripper for moving individual coins from said coin receiving area onto said coin sorting ramp, said coin stripper comprising:

an inlet in communication with said coin receiving area to receive unsorted coins from said coin receiving area;

a backing plate located adjacent said inlet and adapted to support a stack of associated unsorted coins received from said inlet with a face of a lowermost coin of said stack abutting said backing plate, said backing plate located above at least a portion of said coin sorting ramp and defining a space between itself and said ramp that is smaller than a diameter of a smallest-diameter coin being sorted; and, a pushing member located adjacent said backing plate and adapted for reciprocal sliding movement relative to said backing plate between an extended position and a retracted position, said pushing member, when moving from said retracted position to said extended position, engaging said lowermost coin of said stack and moving said lowermost coin onto said coin sorting ramp.

26. A coin stripping apparatus for moving individual coins from an unsorted coin receiving area to a coin sorting mechanism in a coin sorting apparatus, said coin stripping apparatus comprising:

an inlet for holding a stacked plurality of coins;

a backing plate located beneath said inlet to support said stacked plurality of coins;

a planar pushing member located above said backing plate, said pushing member adapted for reciprocal sliding movement in relation to said backing plate between an extended position and a retracted position, said pushing member, when moving from said retracted position to said extended position, engaging a lowermost coin of said stacked plurality of coins and moving said lowermost coin to the coin sorting mechanism, said pushing member defines a leading edge that engages and pushes said lowermost coin simultaneously in a first direction and in a direction transverse relative said first direction to orient said lowermost coin relative to a subjacent sorting ramp.

27. The coin stripping apparatus as set forth in claim 26, wherein said leading edge defines a projecting finger that decreases in width moving away from said pushing member.

28. A coin stripping apparatus for moving individual coins from an unsorted coin receiving area to a coin sorting mechanism in a coin sorting apparatus, said coin stripping apparatus comprising:

an inlet for holding a stacked plurality of coins;

a backing plate located beneath said inlet to support said stacked plurality of coins;

a planar pushing member located above said backing plate, said pushing member adapted for reciprocal sliding movement in relation to said backing plate between an extended position and a retracted position, said pushing member, when moving from said retracted position to said extended position, engaging a lowermost coin of said stacked plurality of coins and moving said lowermost coin to the coin sorting mechanism, said pushing member defining a member that projects upwardly therefrom and that shifts unsorted coins in said inlet away from said pushing member when said pushing member reciprocates.

29. A coin sorting apparatus comprising:

a housing;

a coin sorting mechanism connected to said housing; and, a door assembly mounted on said housing and comprising a plurality of pedestals for retaining a respective plurality of associated coin holders, wherein said door assembly is selectively moveable between a closed position, wherein said associated coin holders are operatively positioned to receive sorted coins from said coin sorting mechanism and said door assembly blocks user access to said associated coin holders, and an open position wherein said door assembly is moved relative to said housing to allow access to said associated coin holders.

30. The coin sorting apparatus of claim 29 further comprising a hinge for connecting said door assembly to said housing.

31. The coin sorting apparatus of claim 29 further comprising a latch for selectively locking said door assembly to said housing.

32. The coin sorting apparatus of claim 29 wherein each of said pedestals defines a different height in relationship to a base of said door assembly.

* * * * *